US006695714B1

(12) United States Patent
Bliss et al.

(10) Patent No.: US 6,695,714 B1
(45) Date of Patent: Feb. 24, 2004

(54) IRON-TYPE GOLF CLUB HEAD WITH BEVELED SOLE

(75) Inventors: John C. Bliss, Glendale, AZ (US); David L. Petersen, Peoria, AZ (US); Michael R. Nicolette, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/385,990

(22) Filed: Mar. 10, 2003

(51) Int. Cl.[7] ..... A63B 53/04

(52) U.S. Cl. ..... 473/328; 473/335; 473/349; 473/350

(58) Field of Search ..... 473/324, 327, 473/328, 329, 330, 331, 349, 350, 334, 335, 290, 291, 344; D21/747, 748, 749, 750, 751

(56) References Cited

U.S. PATENT DOCUMENTS

| | | | | | |
|---|---|---|---|---|---|
| 3,845,955 | A | | 11/1974 | Solheim | |
| 3,897,065 | A | | 7/1975 | Solheim | |
| D240,841 | S | | 8/1976 | Solheim | |
| 4,883,274 | A | * | 11/1989 | Hsien | 473/335 |
| D330,577 | S | | 10/1992 | Solheim | |
| 5,193,805 | A | | 3/1993 | Solheim | |
| 5,377,983 | A | * | 1/1995 | Fenton | 473/328 |
| D368,127 | S | | 3/1996 | Solheim | |
| 5,595,552 | A | | 1/1997 | Wright | |
| 5,603,668 | A | * | 2/1997 | Antonious | 473/328 |
| 5,658,206 | A | * | 8/1997 | Antonious | 473/328 |
| 5,800,281 | A | * | 9/1998 | Gilbert | 473/287 |
| 5,971,866 | A | * | 10/1999 | Adams et al. | 473/328 |
| 6,206,790 | B1 | | 3/2001 | Kubica | |
| 6,251,029 | B1 | * | 6/2001 | Roberts | 473/328 |
| D473,605 | S | * | 4/2003 | Petersen et al. | D21/747 |

* cited by examiner

*Primary Examiner*—Sebastiano Passaniti
(74) *Attorney, Agent, or Firm*—Darrell F. Marquette

(57) ABSTRACT

An iron-type golf club head includes a body having a front face arranged for impact with a golf ball, a heel end, a toe end and a beveled sole. The beveled sole has leading and trailing edges with a ridge located between them. The beveled sole includes a primary surface and a secondary surface, both of which vary in width from the heel end to the toe end. The primary surface is located between the leading edge and the ridge, and the secondary surface is located between the trailing edge and the ridge. The primary surface has a first width dimension adjacent the heel end, a second width dimension measured along a center line located substantially between the heel and toe ends, and a third width dimension adjacent the toe end. The first and third width dimensions of the primary surface are less than the second width dimension of the primary surface. The secondary surface has a first width dimension adjacent the heel end, a second width dimension measured along the center line, and a third width dimension adjacent the toe end. The first and third width dimensions of the secondary surface are greater than the second width dimension of the secondary surface.

10 Claims, 2 Drawing Sheets

IRON-TYPE GOLF CLUB HEAD WITH BEVELED SOLE

BACKGROUND OF THE INVENTION

This invention relates generally to golf equipment and, in particular, to a golf club head of an iron-type.

U.S. Pat. No. 3,897,065 to Karsten Solheim discloses a golf club head to which one end of a shaft is attached. The golf club head has a heel, a toe, and a beveled sole extending between the heel and the toe. The beveled sole includes a trailing portion defined by a ridge that extends from the toe to the heel midway between the leading and trailing edges of the sole. The ridge passes through the neutral axis of the club head where the neutral axis is defined by a plumb line extending from a point located approximately at the center of a grip that is attached to the other end of the shaft.

SUMMARY OF THE INVENTION

The present invention provides a golf club head of an iron-type including a body having a front face arranged for impact with a golf ball, a heel end, a toe end and a beveled sole. The beveled sole has a leading edge disposed along a bottom portion of the front face, a trailing edge disposed rearwardly of the leading edge, and a ridge located between the leading and trailing edges. The beveled sole has a primary surface located between the leading edge and the ridge. The primary surface varies in width from the heel end to the toe end. The primary surface has a first width dimension adjacent the heel end and a second width dimension measured along a center line located substantially midway between the heel and toe ends. The first width dimension of the primary surface is less than the second width dimension of the primary surface. The beveled sole also has a secondary surface located between the trailing edge and the ridge. The secondary surface meets the primary surface along the ridge and is disposed at an obtuse angle to the primary surface. The secondary surface also varies in width from the heel end to the toe end. The secondary surface has a first width dimension adjacent the heel end and a second width dimension measured along the center line. The first width dimension of the secondary surface is greater than the second width dimension of the secondary surface.

The front face preferably has a loft angle of at least 48 degrees, and a hosel with a longitudinal axis may be connected to the heel end of the body. The primary surface of the beveled sole has a heel extension that is intersected by the longitudinal axis of the hosel. The body may also have a back face opposite the front face with an elongated cavity formed in therein. A weight member is disposed in the cavity. The primary surface of the beveled sole may have a third width dimension adjacent the toe end. The third width dimension of the primary surface is less than the second width dimension of the primary surface. The secondary surface of the beveled sole may have a third width dimension adjacent the toe end. The third width dimension of the secondary surface is greater than the second width dimension of the secondary surface.

DESCRIPTION OF THE PREFERRED EMBODIMENT

Figure 1:
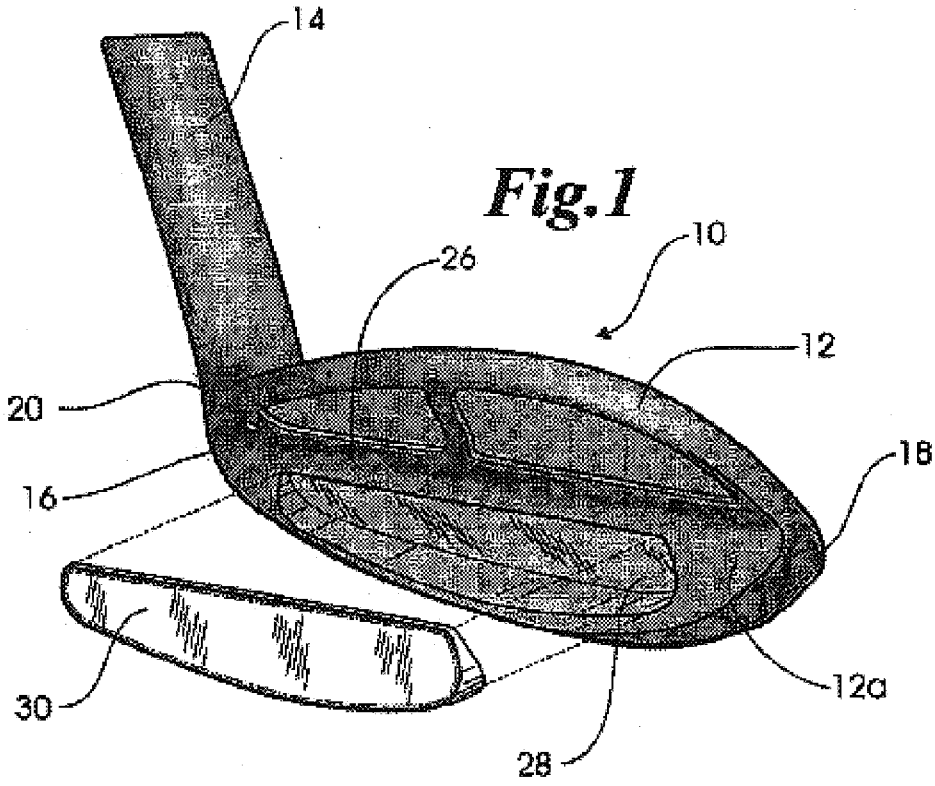
FIG. 1 is a perspective view of a golf club head embodying the present invention.
Figure 2:
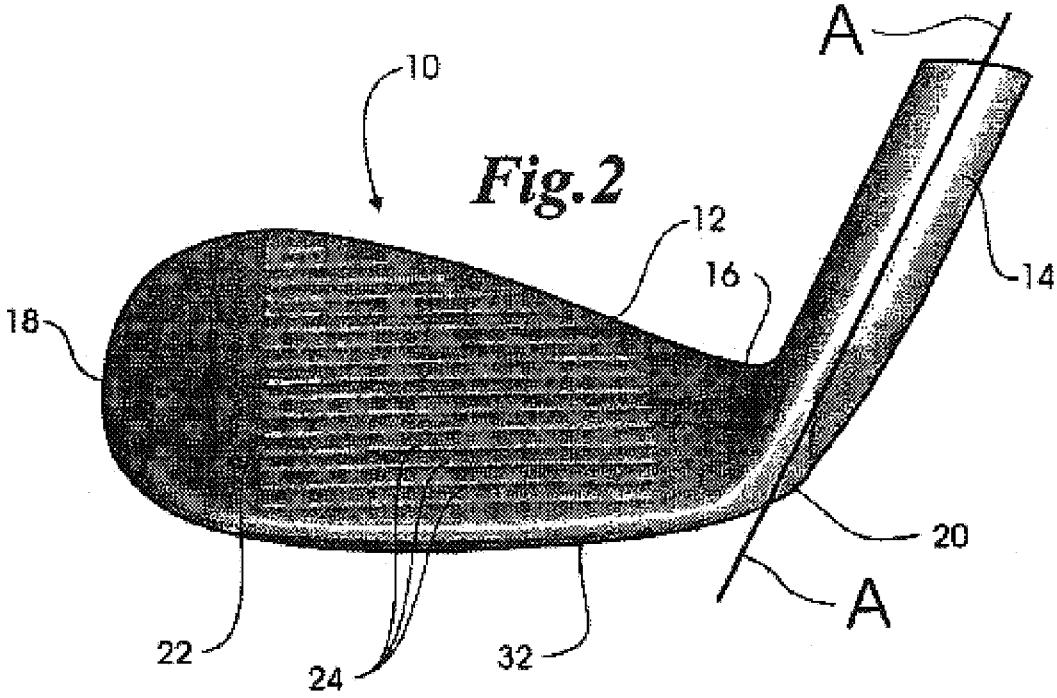
FIG. 2 is front elevational view of the golf club head shown in FIG. 1.
Figure 3:
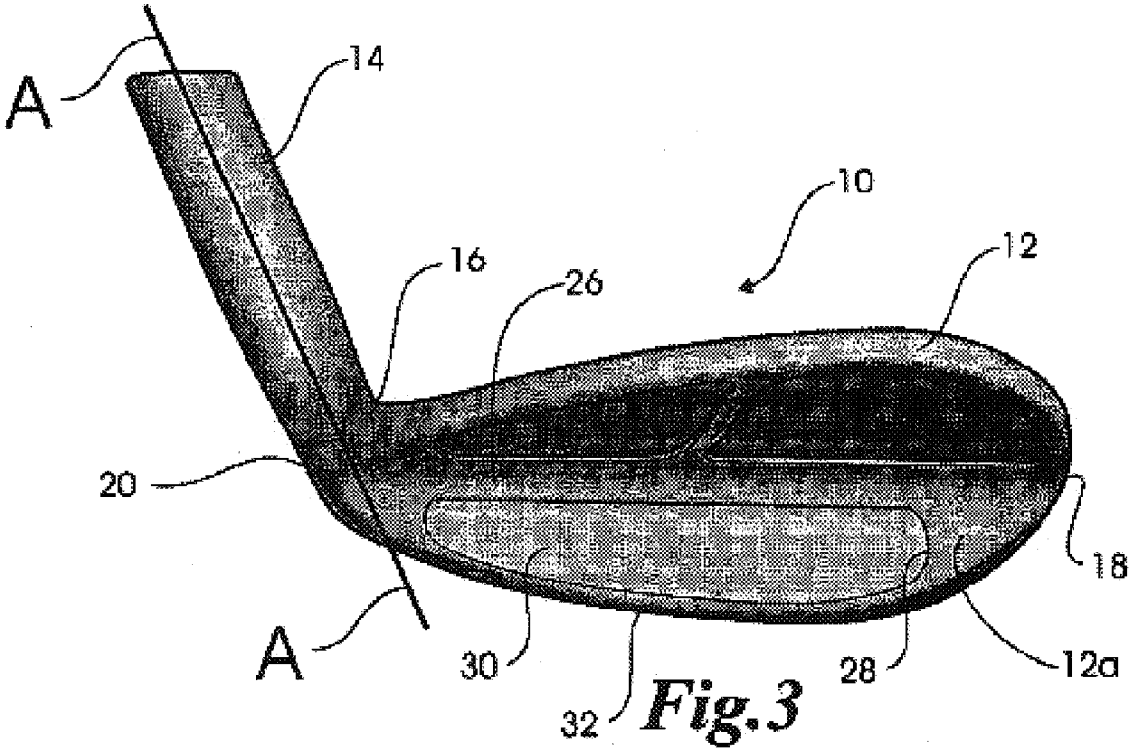
FIG. 3 is a rear elevational view of the golf club head shown in FIG. 1.

Referring to FIGS. 1–3, a golf club head 10 includes a body 12 and a hosel 14 for receiving one end of a shaft (not shown). The hosel 14 has a longitudinal axis A. The body 12 has a heel end 16 and a toe end 18 that are spaced apart, and the hosel 14 includes a neck 20 connected to the heel end 16 of the body 12. The club head 10 is preferably cast from suitable metal such as stainless steel. A front face 22 arranged for impact with a golf ball is provided on the body 12 and extends between the heel and toe ends 16, 18. The front face 22 is provided with a plurality of grooves 24 and preferably has a loft angle of at least 48 degrees.

The body 12 includes a back face 26 opposite the front face 22. The back face 26 has an elongated cavity 28 formed therein, and a weight member 30 is disposed in the cavity 28. The cavity 28 extends into a lower thickened section 12*a* of the body 12. The weight member 30 is preferably made of polymer containing tungsten powder and is selected from a plurality of weight members (not shown) of different weights. By selecting a particular weight member, the club head 10 may have its overall weight adjusted to a particular level.

Figure 4:
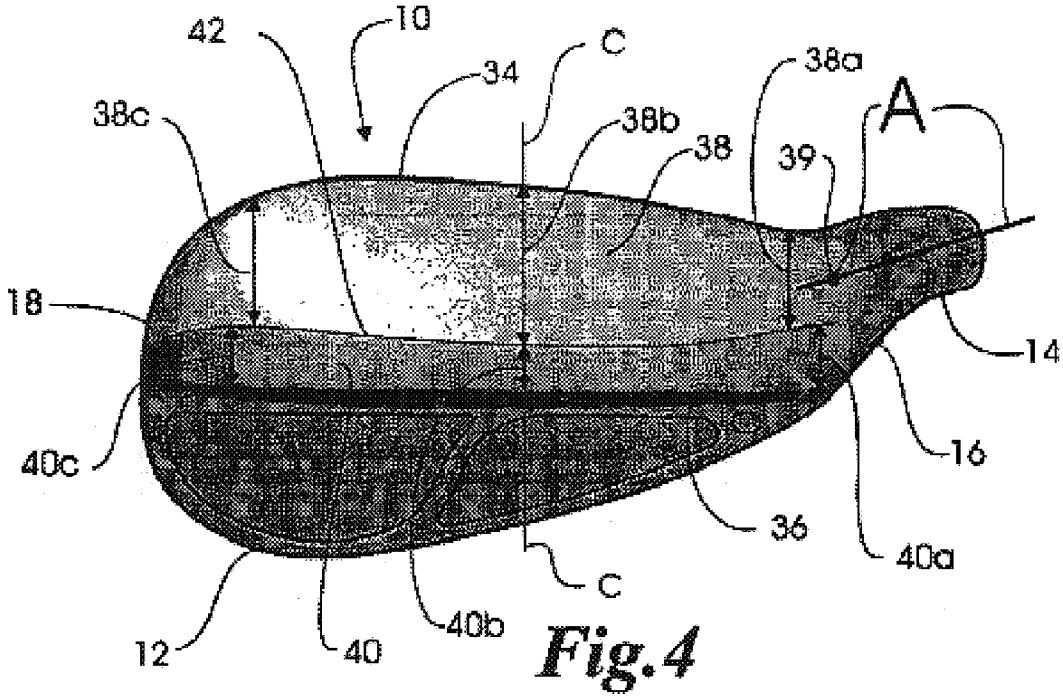
FIG. 4 is a bottom view of the golf club head shown in FIG. 1.

According to the present invention, the club head 10 has a beveled sole 32 with a leading edge 34 disposed along a bottom portion of the front face 22 and a trailing edge 36 disposed rearwardly of the leading edge 34 as shown in FIG. 4. The beveled sole 32 includes a primary surface 38 and a secondary surface 40 which are disposed at an acute angle to each other and meet along a ridge 42 that is located between the leading and trailing edges 34, 36. The primary surface 38 is located between the leading edge 34 and the ridge 42 while the secondary surface 40 is located between the trailing edge 36 and the ridge 42. Both the primary and secondary surfaces 38, 40 vary in width between the heel and toe ends 16, 18 of the body 12. The primary surface 38 has a heel extension 39 that is intersected by the longitudinal axis A of the hosel 14. The longitudinal axis A does not pass through the ridge 42 since the ridge 42 is offset toward the trailing edge 36. The heel extension 39 of the primary surface 38 improves the performance of the club head 10 by allowing it to pass through grass or sand without digging in.

The primary surface 38 has a first width dimension 38*a* adjacent the heel end 16, a second width dimension 38*b* measured along a center line C located substantially midway between the heel and toe ends 16, 18, and a third width dimension 38*c* adjacent the toe end 18. In the preferred embodiment of the club head 10, the first and third width dimensions 38*a*, 38*c* are less than the second width dimension 38*b*. The secondary surface 40 has a first width dimension 40*a* adjacent the heel end 16, a second width dimension 40*b* measured along the center line C, and a third width dimension 40*c* adjacent the toe end 18. In the preferred embodiment of the club head 10, the first and third width dimensions 40*a*, 40*c* are greater than the second width dimension 40*b*.

What is claimed is:

1. A golf club head of an iron-type comprising:

a body having a front face arranged for impact with a golf ball, a heel end, a toe end and a beveled sole;

said beveled sole having a leading edge disposed along a bottom portion of said front face, a trailing edge disposed rearwardly of said leading edge, and a ridge located between said leading and trailing edges;

said beveled sole having a primary surface located between said leading edge and said ridge, said primary surface varying in width from said heel end to said toe end, said primary surface having a first width dimension adjacent said heel end and a second width dimension measured along a center line located substantially midway between said heel and toe ends, said first width dimension of said primary surface being less than said second width dimension of said primary surface; and said beveled sole also having a secondary surface located between said trailing edge and said ridge, said secondary surface meeting said primary surface along said ridge and being disposed at an obtuse angle to said primary surface, said secondary surface also varying in width from said heel end to said toe end, said secondary surface having a first width dimension adjacent said heel end and a second width dimension measured along said center line, said first width dimension of said secondary surface being greater than said second width dimension of said secondary surface.

2. The golf club head of claim 1, wherein said front face has a loft angle at least 48 degrees.

3. The golf club head of claim 1, further comprising:

a hosel connected to said heel end of said body and adapted for receiving a shaft, said hosel having a longitudinal axis; and said primary surface of said beveled sole has a heel extension that is intersected by the longitudinal axis of said hosel.

4. The golf club head of claim 1, further comprising:

said body including a back face opposite said front face;

said back face having an elongated cavity formed therein; and a weight member disposed in said cavity.

5. The golf club head of claim 4, wherein said cavity extends into a lower thickened section of said body.

6. The golf club head of claim 1, wherein said primary surface of said beveled sole has a third width dimension adjacent said toe end, and wherein said third width dimension of said primary surface is less than said second width dimension of said primary surface.

7. The golf club head of claim 1, wherein said secondary surface of said beveled sole has a third width dimension adjacent said toe end, and wherein said third width dimension of said secondary surface is greater than said second width dimension of said secondary surface.

8. A golf club head of an iron-type comprising:

a body having a front face arranged for impact with a golf ball, a heel end, a toe end and a beveled sole;

said beveled sole having a leading edge disposed along a bottom portion of said front face, a trailing edge disposed rearwardly of said leading edge, and a ridge located between said leading and trailing edges;

said beveled sole having a primary surface located between said leading edge and said ridge, said primary surface varying in width from said heel end to said toe end, said primary surface having a first width dimension adjacent said heel end, a second width dimension measured along a center line located substantially midway between said heel and toe ends and a third width dimension adjacent said toe end, said first and third width dimensions of said primary surface being less than said second width dimension of said primary surface; and said beveled sole also having a secondary surface located between said trailing edge and said ridge, said secondary surface meeting said primary surface along said ridge and being disposed at an obtuse angle to said primary surface, said secondary surface also varying in width from said heel end to said toe end, said secondary surface having a first width dimension adjacent said heel end, a second width dimension measured along said center line and a third width dimension adjacent said toe end, said first and third width dimensions of said secondary surface being greater than said second width dimension of said secondary surface.

9. The golf club head of claim 8, further comprising:

a hosel connected to said body and adapted for receiving a shaft, said hosel having a longitudinal axis; and said primary surface of said beveled sole having a heel extension intersected by the longitudinal axis of said hosel.

10. A golf club head of an iron-type comprising:

a body having a front face arranged for impact with a golf ball, a back face opposite said front face, a heel end, a toe end and a beveled sole, said front face having a loft angle of at least 48 degrees, said back face having an elongated cavity extending into a thickened section of said body;

a weight member disposed in said cavity;

a hosel connected to said heel end of said body and adapted for receiving a shaft, said hosel having a longitudinal axis;

said beveled sole having a leading edge disposed along a bottom portion of said front face, a trailing edge disposed rearwardly of said leading edge, and a ridge located between said leading and trailing edges;

said beveled sole having a primary surface located between said leading edge and said ridge, said primary surface varying in width from said heel end to said toe end, said primary surface having a first width dimension adjacent said heel end, a second width dimension measured along a center line located substantially midway between said heel and toe ends and a third width dimension adjacent said toe end, said first and third width dimensions of said primary surface being less than said second width dimension of said primary surface;

said primary surface of said beveled sole having a heel extension intersected by the longitudinal axis of said hosel; and said beveled sole also having a secondary surface located between said trailing edge and said ridge, said secondary surface meeting said primary surface along said ridge and being disposed at an obtuse angle to said primary surface, said secondary surface also varying in width from said heel end to said toe end, said secondary surface having a first width dimension adjacent said heel end, a second width dimension measured along said center line and a third width dimension adjacent said toe end, said first and third width dimensions of said secondary surface being greater than said second width dimension of said secondary surface.

* * * * *